US005525168A

United States Patent [19]

Sawada et al.

[11] Patent Number: 5,525,168

[45] Date of Patent: Jun. 11, 1996

[54] METHOD OF PRODUCING SUPPORT FOR PLANOGRAPHIC PRINTING PLATE

[75] Inventors: Hirokazu Sawada; Akio Uesugi, both of Shizuoka, Japan

[73] Assignee: Fuji Photo Film Co., Ltd., Kanagawa, Japan

[21] Appl. No.: 305,037

[22] Filed: Sep. 13, 1994

[30] Foreign Application Priority Data

Sep. 13, 1993 [JP] Japan ..... 5-249699

[51] Int. Cl.[6] ..... C22C 21/12

[52] U.S. Cl. ..... 148/416; 148/692

[58] Field of Search ..... 148/551, 552, 148/692, 695, 696, 437, 416; 420/550

[56] References Cited

U.S. PATENT DOCUMENTS

| | | | |
|---|---|---|---|
| 4,435,230 | 3/1984 | Fujikura | 148/692 |
| 5,078,805 | 1/1992 | Uesugi et al. | 148/2 |
| 5,350,010 | 9/1994 | Sawada et al. | 148/551 |

FOREIGN PATENT DOCUMENTS

| | | | |
|---|---|---|---|
| 0415238 | 3/1991 | European Pat. Off. . | |
| 0581321A2 | 7/1993 | European Pat. Off. . | |
| 60-230951 | 11/1985 | Japan . | |
| 60-238001 | 11/1985 | Japan . | |
| 2074060 | 4/1987 | Japan | 148/692 |
| 5201166 | 10/1993 | Japan . | |

OTHER PUBLICATIONS

Cayless et al, "Alloy and Temper Designation Systems for Aluminum and Aluminum Alloys", *Metals Handbook: American Society for Metals,* 2(1–4):15–17 (Dec. 1990).

*Primary Examiner*—Scott Kastler

*Attorney, Agent, or Firm*—Sughrue, Mion, Zinn, Macpeak & Seas

[57] ABSTRACT

Disclosed are (i) a method of producing a support for planographic printing plate, which comprises melting an aluminum ingot having an aluminum content of not less than 99.7 wt % to prepare a cast ingot, scalping the surface of the cast ingot, soaking the scalped cast ingot, cold rolling the soaked ingot to a thickness of 0.1 to 0.5 mm, correction of the resulting sheet to prepare an aluminum support, and then graining the aluminum support and (ii) a method of producing a support for planographic printing plate, which comprises melting an aluminum ingot having an aluminum content of not less than 99.7 wt % to prepare a cast ingot in a melt holding furnace, directly subjecting the cast ingot to continuous casting to prepare a thin sheet having a thickness of 2 to 30 mm, cold rolling the thin sheet, correction of the resulting sheet to prepare an aluminum support, and then graining the aluminum support.

4 Claims, 3 Drawing Sheets

METHOD OF PRODUCING SUPPORT FOR PLANOGRAPHIC PRINTING PLATE

FIELD OF THE INVENTION

The present invention relates to a method of producing a support for planographic printing plate and more particularly relates to a method of producing an aluminum support which is superior in an electrolytically graining property.

BACKGROUND OF THE INVENTION

As an aluminum support for printing plate, particularly for offset printing plate there is used an aluminum plate (including aluminum alloy plate).

In general, an aluminum plate to be used as a support for offset printing plate needs to have a proper adhesion to a photographic light-sensitive material and a proper water retention.

The surface of the aluminum plate should be uniformly and finely grained to meet the aforesaid requirements. This graining process largely affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example, a normal alternating waveform such as a sinewaveform, a special alternating waveform such as a squarewaveform, and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic power source (JP-A-53-67507). (The term "JP-A" as used herein means an "unexamined published Japanese patent application".) Another method is to control a ratio between an electricity quantity of a positive period and that of a negative period at the time of alternating electrolytic graining (JP-A-54-65607). Still another method is to control the waveform supplied from an electrolytic power source (JP-A-55-25381). Finally, another method is directed to a combination of current density (JP-A-56-29699).

Further, known is a graining method using a combination of an AC electrolytic etching method with a mechanical graining method (JP-A-55-142695).

As the method of producing an aluminum support, on the other hand, known is a method in which an aluminum ingot is melted and held, and then cast into a slab (having a thickness in a range from 400 to 600 mm, a width in a range from 1,000 to 2,000 mm, and a length in a range from 2,000 to 6,000 mm). Then, the cast slab thus obtained is subjected to a scalping step in which the slab surface is scalped by 3 to 10 mm with a scalping machine so as to remove an impurity structure portion on the surface. Next, the slab is subjected to a soaking treatment step in which the slab is kept in a soaking furnace at a temperature in a range from 480° to 540° C. for a time in a range from 6 to 12 hours, thereby to remove any stress inside the slab and make the structure of the slab uniform. Then, the thus treated slab is hot rolled at a temperature in a range from 480° to 540° C. to a thickness in a range from 5 to 40 mm. Thereafter, the hot rolled slab is cold rolled at room temperature into a plate of a predetermined thickness. Then, in order to make the structure uniform and improve the flatness of the plate, the thus cold rolled plate is annealed thereby to make the rolled structure, etc. uniform, and the plate is then subjected to correction by cold rolling to a predetermined thickness. Such an aluminum plate obtained in the manner described above has been used as a support for a planographic printing plate.

However, electrolytic graining is apt to be influenced by an aluminum support to be treated. If an aluminum support is prepared through melting and holding, casting, scalping and soaking, even though passing through repetition of heating and cooling followed by scalping of a surface layer, scattering of the metal alloy components is generated in the surface layer, causing a drop in the yield of a planographic printing plate.

In this connection, the present inventors have previously proposed a method of producing a support for planographic printing plate, which comprises continuously performing casting and hot-rolling from molten aluminum to form a hot-rolled coil of a thin plate, transforming the hot-rolled coil into an aluminum support through cold-rolling, heat-treatment and correction, and finally, graining the aluminum support (U.S. Pat. No. 5,078,805 which corresponds to JP-A-3-79798).

However, even the preparation methods which have been previously proposed by the present inventors give the non-uniformity of the yield of electrolytic graining and the graining property due to the components of aluminum support.

Further, in order to prepare an aluminum alloy having the foregoing composition, a method is normally employed which comprises melting an ingot having an aluminum content of not less than 99.7%, and then adding an aluminum mother alloy containing predetermined amounts of Fe, Si and Cu to the molten aluminum. This aluminum mother alloy is expensive as compared with an aluminum ingot, raising the cost of aluminum alloy.

SUMMARY OF THE INVENTION

An object of the present invention is to provide a method of producing a support for planographic printing plate which is superior in graining property and which reduces the non-uniformity in quality of materials for aluminum support, thereby improving the yield of electrolytic graining as well as enabling the production of a low cost planographic printing plate.

The present inventors have made extensive studies on the relationship between aluminum support and electrolytic graining. As a result, the present inventors worked out the present invention.

In particular, the foregoing object of the present invention is accomplished with:

(i) a method of producing a support for planographic printing plate, which comprises melting an aluminum ingot having an aluminum content of not less than 99.7 wt % to prepare a cast ingot, scalping the surface of the cast ingot, soaking the scalped cast ingot, cold rolling the soaked ingot to a thickness of 0.1 to 0.5 mm, without followed by annealing, correction of the resulting sheet to prepare an aluminum support, and then graining the aluminum support; and (ii) a method of producing a support for planographic printing plate, which comprises melting an aluminum ingot having an aluminum content of not less than 99.7 wt % to prepare a cast ingot in a melt holding furnace, directly subjecting the cast ingot to continuous casting to prepare a thin sheet having a thickness of 2 to 30 mm, cold rolling the thin sheet, without followed by annealing, correction of the resulting sheet to prepare an aluminum support, and then graining the aluminum support.

DETAILED DESCRIPTION OF THE INVENTION

In the present invention, as the method for preparing an aluminum cast ingot from molten aluminum in, e.g., a fixed casting mold, a casting technique such as DC method has been put into practical use.

Further, as a continuous casting method employing a driven casting mold there can be used a method employing a cooling belt such as Hapelett method or a method employing a cooling roller such as Hunter method and 3C method. Moreover, JP-A-60-238001, JP-A-60-240360, etc. disclose a method for preparing a coil of thin sheet.

According to conventional methods, when a support for printing plate is prepared only from an aluminum ingot having an aluminum content of not less than 99.7 wt %, it is disadvantageous in that the shape of grain is collapsed during electrolytic graining. The present invention provides a method of producing a support for planographic printing plate having a good adaptability to electrolytic graining by correction without heat treatment after cold rolling.

Figure 1:
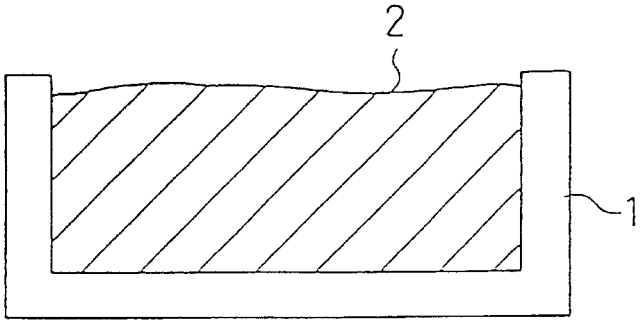
FIG. 1(A) and 1(B) illustrate the concept of an embodiment of the casting process in the method of producing a support for planographic printing plate according to the present invention, in which 1 indicates a casting mold, 2 and 6 indicate a cast ingot, 3 indicates a water-cooled casting mold, 4 indicates a cast ingot receiving tray, and 5 indicates a molten aluminum supplying nozzle.
Figure 1:
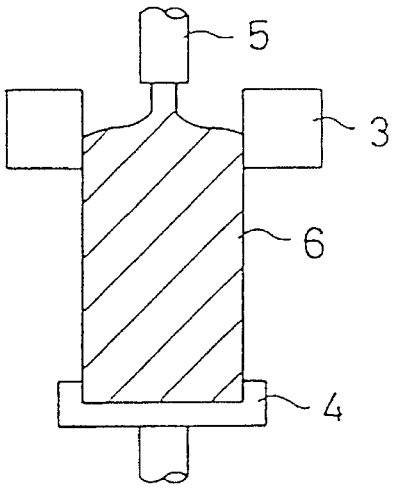
Figure 2:
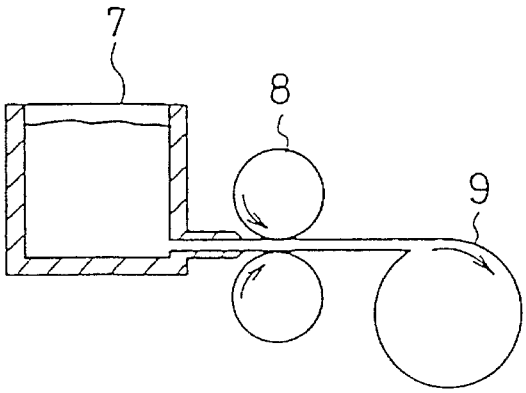
FIG. 2 illustrates the concept of another embodiment of the casting process in the method of producing a support for planographic printing plate according to the present invention, in which 7 indicates a melt holding furnace, 8 indicates a twin-roller continuous casting machine, and 9 indicates a coiler.
Figure 3:
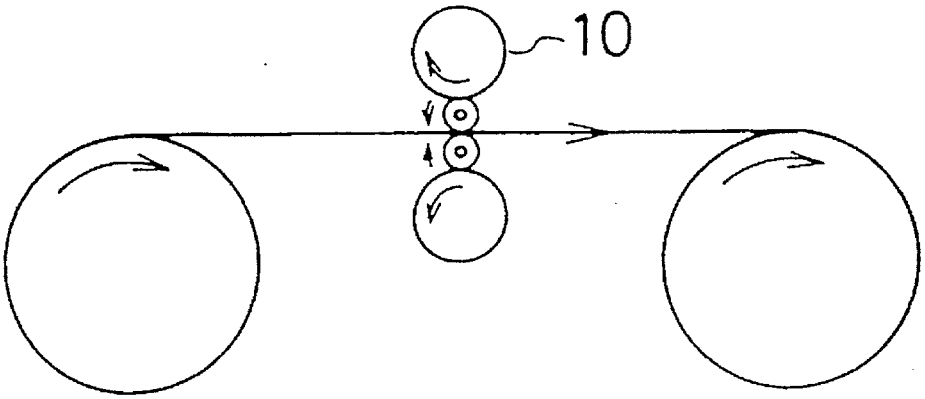
FIG. 3 illustrates the concept of an embodiment of the cold rolling process in the method of producing a support for planographic printing plate according to the present invention, in which 10 indicates a cold rolling machine.
Figure 4:
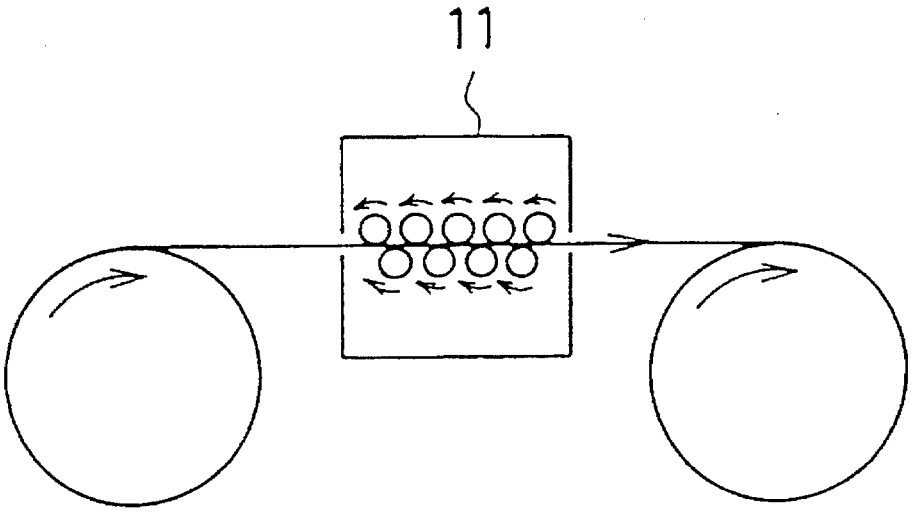
FIG. 4 illustrates the concept of an embodiment of the correction process in the method of producing a support for planographic printing plate according to the present invention, in which 11 indicates a correction machine.

Referring to FIGS. 1(A), 1(B), 2, 3 and 4, an embodiment of the method of producing an aluminum support according to the present invention will be further described. As shown in FIG. 1(A), the reference number 1 is a casting mold in which an ingot is formed into cast ingot 2. Alternatively, as shown in FIG. 1(B), molten aluminum may be supplied into cast ingot receiving tray 4 from molten aluminum supplying nozzle 5 through water-cooled casting mold 3 to prepare cast ingot 6. Further, as shown in FIG. 2, an aluminum ingot may be melted in melt holding furnace 7, and then formed into a sheet having a thickness of 2 to 30 mm by means of twin-roller continuous casting machine 8. In a case of using a cast ingot, it is scalped to a certain extent, soaked, cold rolled to a thickness of 0.1 to 0.5 mm as shown in FIG. 3, and then corrected as shown in FIG. 4 to prepare an aluminum support. In this process, soaking is effected before cold rolling. In the case where an aluminum ingot is melted in melt holding furnace 7 and formed into a sheet having a thickness of about 4 to 30 mm by twin-roller continuous casting machine 8, the sheet is then cold rolled by cold rolling machine 10 as shown in FIG. 3, and then, without followed by annealing, correction by correction machine 11 as shown in FIG. 4 to prepare a support.

The feature of the present invention is that no annealing treatment is effected after cold rolling.

In the present invention, the soaking treatment is conducted at a temperature of 280° to 650° C., preferably 400° to 630° C., more preferably 500° to 600° C. for a period of 2 to 15 hours, preferably 4 to 12 hours, more preferably 6 to 11 hours.

In the present invention, while a variety of known continuous casting methods is applicable, preferred are a twin-roller continuous casting method and a twin-belt continuous casting method. In a case of using the twin-roller continuous casting method, it is preferred that a cast ingot is cast to a thin sheet having a thickness of 2 to 10 mm. In a case of using the twin-belt continuous casting method, it is preferred that a cast ingot is cast to a sheet having a thickness of 10 to 30 mm, subsequently the sheet is hot rolled to a thickness of 2 to 10 mm (before cold rolling).

As the method for graining the support for planographic printing plate according to the present invention, there is used mechanical graining, chemical graining, electrochemical graining or combination thereof.

Examples of mechanical graining methods include ball graining, wire graining, brush graining, and liquid honing. As electrochemical graining method, there is normally used AC electrolytic etching method. As electric current, there is used a normal alternating current such as sinewaveform or a special alternating current such as squarewaveform, and the like. As a pretreatment for the electrochemical graining, etching may be conducted with caustic soda.

If electrochemical graining is conducted, it is preferably with an alternating current in an aqueous solution mainly composed of hydrochloric acid or nitric acid. The electrochemical graining will be further described hereinafter.

First, the aluminum is etched with an alkali. Preferred examples of alkaline agents include caustic soda, caustic potash, sodium metasilicate, sodium carbonate, sodium aluminate, and sodium gluconate. The concentration of the alkaline agent, the temperature of the alkaline agent and the etching time are preferably selected from 0.01 to 20%, 20° to 90° C. and 5 sec. to 5 min., respectively. The preferred etching rate is in the range of 0.1 to 5 $g/m^2$.

In particular, if the support contains a large amount of impurities, the etching rate is preferably in the range of 0.01 to 1 g/m$^2$ (JP-A-1-237197). Since alkaline-insoluble substances (smut) are left on the surface of the aluminum plate thus alkali-etched, the aluminum plate may be subsequently desmutted as necessary.

The pretreatment is effected as mentioned above. In the present invention, the aluminum plate is subsequently subjected to AC electrolytic etching in an electrolyte mainly composed of hydrochloric acid or nitric acid. The frequency of the AC electrolytic current is in the range of 0.1 to 100 Hz, preferably 0.1 to 1.0 Hz or 10 to 60 Hz.

The concentration of the etching solution is in the range of 3 to 150 g/l, preferably 5 to 50 g/l. The solubility of aluminum in the etching bath is preferably in the range of not more than 50 g/l, more preferably 2 to 20 g/l. The etching bath may contain additives as necessary. However, in mass production, it is difficult to control the concentration of such an etching bath.

The electric current density in the etching bath is preferably in the range of 5 to 100 A/dm$^2$, more preferably 10 to 80 A/dm$^2$. The waveform of electric current can be properly selected depending on the required quality and the components of aluminum support used but may be preferably a special alternating waveform as described in JP-B-56-19280 and JP-B-55-19191. (The term "JP-B" as used herein means an "examined Japanese patent publication"). The waveform of electric current and the liquid conditions are properly selected depending on required electricity as well as required quality and components of aluminum support used.

The aluminum plate which has been subjected to electrolytic graining is then subjected to dipping in an alkaline solution as a part of desmutting treatment to dissolve smutts away. As such an alkaline agent, there may be used caustic soda or the like. The desmutting treatment is preferably effected at a pH value of not lower than 10 and a temperature of 25° to 60° C. for a dipping time as extremely short as 1 to 10 seconds.

The aluminum plate thus etched is then dipped in a solution mainly composed of sulfuric acid. It is preferred that the sulfuric acid solution is in the concentration range of 50 to 400 g/l, which is much lower than the conventional value, and the temperature range of 25° to 65° C. If the concentration of sulfuric acid is more than 400 g/l or the temperature of sulfuric acid is more than 65° C., the processing bath is more liable to corrosion, and in an aluminum alloy comprising not less than 0.3% of manganese, the grains formed by the electrochemical graining is collapsed. Further, if the aluminum plate is etched by more than 0.2 g/m$^2$, the printing durability reduces. Thus, the etching rate is preferably controlled to not more than 0.2 g/m$^2$.

The aluminum plate preferably forms an anodized film thereon in an amount of 0.1 to 10 g/m$^2$, more preferably 0.3 to 5 g/m$^2$.

The anodizing conditions vary with the electrolyte used and thus are not specifically determined. In general, it is appropriate that the electrolyte concentration is in the range of 1 to 80% by weight, the electrolyte temperature is in the range of 5° to 70° C., the electric current density is in the range of 0.5 to 60 A/dm$^2$, the voltage is in the range of 1 to 100 V, and the electrolysis time is in the range of 1 second to 5 minutes.

The grained aluminum plate having an anodized film thus obtained is stable and excellent in hydrophilicity itself and thus can directly form a photosensitive coat thereon. If necessary, the aluminum plate may be further subjected to surface treatment.

For example, a silicate layer formed by the foregoing metasilicate of alkaline metal or an undercoating layer formed by a hydrophilic polymeric compound may be formed on the aluminum plate. The coating amount of the undercoating layer is preferably in the range of 5 to 150 mg/m$^2$.

A photosensitive coat is then formed on the aluminum plate thus treated. The photosensitive printing plate is imagewise exposed to light, and then developed to make a printing plate, which is then mounted in a printing machine for printing.

The present invention will be further described in the following non-limiting examples. Unless otherwise indicated, all parts, percents, ratios and the like are by weight.

EXAMPLE 1

A commercially available ingot having an aluminum content of not less than 99.7% (including 0.085% of Fe, 0.034% of Si and almost 0 (zero) % of Cu as impurities) was melted, and then formed into a cast ingot in a carbon casting mold at a casting temperature of 750° C. as shown in FIG. 1(A). The cast ingot was scalped by about 10 mm, subjected to soaking at a temperature of 550° C. for 10 hours, and then finished to a thickness of 0.24 mm only by cold rolling to prepare a sample of Example 1 of the present invention.

COMPARATIVE EXAMPLES 1 AND 2

Figure 5:
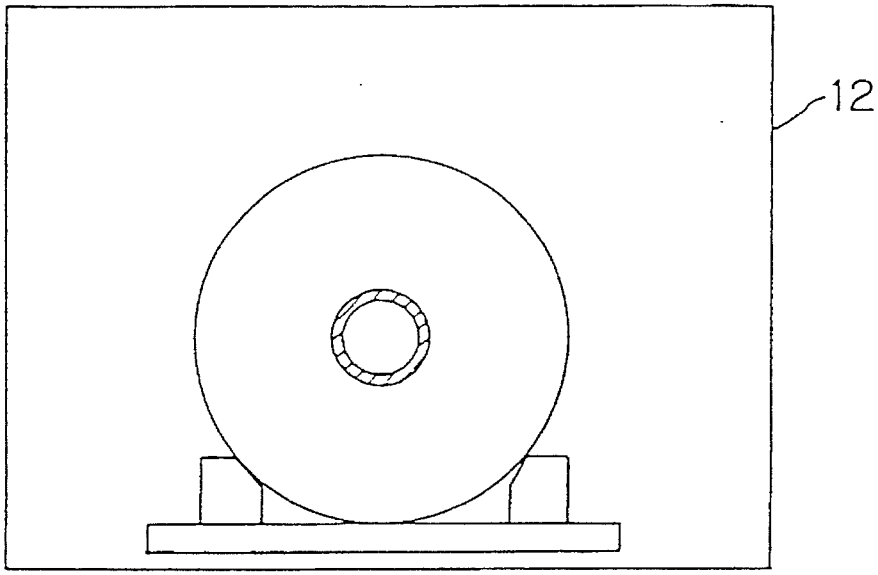
FIG. 5 illustrates the concept of an embodiment of the heat treatment process for intermediate annealing in a conventional method of producing a support for planographic printing plate, in which 12 represents a heat treatment furnace for intermediate annealing.

In order to prepare a JIS1050 material that can be widely used as a support for planographic printing plate, various mother alloys were added to a commercially available ingot to make a composition consisting of 0.35% of Fe, 0.07% of Si, 0.01% of Cu, 0.03% of Ti, and a balance of Al and unavoidable impurities. The ingot was then formed into a cast ingot in the same manner as in Example 1. The cast ingot was scalped by an ordinary method, subjected to soaking, subjected to cold rolling and intermediate annealing (using an apparatus as shown in FIG. 5) once or more times, and then cold rolled again so that it was finished to a thickness of 0.24 mm to prepare a sample of Comparative Example 1.

As another comparative example, a cast ingot was prepared from an ingot having an aluminum content of 99.7%. The cast ingot was then finished to a thickness of 0.24 mm in the same manner as in Comparative Example 1 to prepare a sample of Comparative Example 2.

The aluminum plates thus prepared were used as supports for planographic printing plate. These supports were etched with a 15% aqueous solution of caustic soda at a temperature of 50° C. at an etching rate of 5 g/m$^2$, washed with water, desmutted with a 150 g/l sulfuric acid at a temperature of 50° C. for 10 seconds, and then washed with water.

These supports were then subjected to electrochemical graining with an alternating current as described in JP-B-55-19191 in a 16 g/l nitric acid. The electrolysis conditions were 14 V for anode voltage $V_A$, 12 V for cathode voltage $V_c$, and 350 coulomb/dm$^2$ for anodic electricity.

Without coating a photosensitive layer, the substrates 1 to 3 thus prepared were then evaluated for uniformity in appearance and grain shape (evaluated by observing a view of grained surface enlarged by a scanning electron microscope). At the same time, the cost of the raw materials of these substrates were compared. The results are set forth in Table 1.

TABLE 1

| | Component | Rolling method | Uniformity in appearance | Grain shape | Cost ratio of raw materials |
|---|---|---|---|---|---|
| Ex. 1: | Al, 99.7% | Cold rolling | Good | Good | 100 |
| C.Ex. 1: | JIS1050 | Cold rolling + Intermediate annealing | Streak unevenness | Good | 106 |
| C.Ex. 2: | Al, 99.7% | Cold rolling + Intermediate annealing | Streak unevenness | Melted, poor | 100 |

As mentioned above, the example of the present invention exhibits a good appearance and grain shape and an excellent adaptability to graining. Further, the example of the present invention has a great effect of reducing the cost of raw materials. In accordance with the present invention, a planographic printing plate can be prepared only from a commercially available ingot having an aluminum content of not less than 99.7%, thereby enabling a drastic cost reduction.

Moreover, the present invention can employ a simplified rolling method, enabling a production cost reduction.

While casting is effected with a carbon casting mold in Example 1, the present invention is not limited thereto. Twin-roller continuous casting method as shown in FIG. 2 and twin-belt continuous casting method can be used to accomplish the same effects as above.

EXAMPLE 2

Referring to FIG. 2 which illustrates the concept of a casting process, another embodiment of the process for producing an aluminum support to be used in the present invention will be described below.

An aluminum ingot having an aluminum content of not less than 99.7% (including 0.085% of Fe, 0.034% of Si, and almost 0 (zero) % of Cu as impurities) was melted in melt holding furnace 7, and then continuously casted into a sheet having a thickness of 7 mm by twin-roller continuous casting machine 8. The sheet was wound on coiler 9, and then subsequently subjected to treatment by cold rolling machine 10 and correction machine 11 as shown in FIGS. 3 and 4, respectively, to prepare an aluminum support as a sample of Example 2 of the present invention.

COMPARATIVE EXAMPLE 3

An aluminum ingot having an aluminum content of not less than 99.7% was melted and held with a mother alloy of Fe, Si, Cu and Ti being added thereto so that a composition comprising 0.35% of Fe, 0.07% of Si, 0.01% of Cu and 0.03% of Ti was made. The cast ingot thus prepared was then casted in the same manner as in Example 2 to prepare an aluminum support as a sample of Comparative Example 3.

These samples were then subjected to graining in the same manner as in Example 1 and Comparative Examples 1 and 2, anodized by an ordinary method, and then coated with a photosensitive layer to prepare photosensitive planographic printing plates. These photosensitive planographic printing plates were exposed to light, developed, and then gummed to prepare planographic printing plates. These planographic printing plates were then used for printing in an ordinary manner. The results of the printing properties as well as the results of uniformity in appearance after graining and the comparison of the cost of raw materials are set forth in Table 2.

TABLE 2

| | Component | Rolling method | Results of printing | Uniformity in appearance | Cost ratio of-raw materials |
|---|---|---|---|---|---|
| Ex. 2: | Al, 99.7% | Cold rolling | Good | Good | 100 |
| C.Ex. 3: | JIS1050 | Cold rolling | Acceptable | Poor | 106 |

As mentioned above, the sample of the present invention can provide improved results of printing, a drastically improved appearance and a reduction of the cost of raw materials.

As mentioned above, the planographic printing plate prepared according to the method of producing a support for planographic printing plate of the present invention exhibits an improved adaptability to electrolytic graining as compared with conventional planographic printing plates, thereby enabling a drastic reduction of the cost of raw materials. Further, the present invention eliminates the necessity of blending of raw materials with a mother alloy, eliminating the drop of yield due to blending and hence enhancing the yield.

Moreover, the simplification of cold rolling process gives a great effect of reducing the production cost, providing a great contribution to the quality improvement and cost reduction of support for planographic printing plate.

While the invention has been described in detail and with reference to specific embodiments thereof, it will be apparent to one of ordinary skill in the art that various changes and modifications can be made therein without departing from the spirit and scope thereof.

What is claimed is:

1. A method of producing a support for planographic printing plate, which consists essentially of melting an aluminum ingot having an aluminum content of not less than 99.7 wt % to prepare a cast ingot, scalping the surface of the cast ingot, soaking the scalped cast ingot, cold rolling the soaked ingot to a thickness of 0.1 to 0.5 mm, correction of the resulting sheet to prepare an aluminum support, and then graining the aluminum support.

2. A method of producing a support for planographic printing plate, which consists essentially of melting an aluminum ingot having an aluminum content of not less than 99.7 wt % to prepare a cast ingot in a melt holding furnace, directly subjecting the cast ingot to continuous casting to prepare a thin sheet having a thickness of 2 to 30 mm, cold rolling the thin sheet, correction of the resulting sheet to prepare an aluminum support, and then graining the aluminum support.

3. A method of producing a support for planographic printing plate as claimed in claim 2, which consists essentially of melting an aluminum ingot having an aluminum content of not less than 99.7 wt % to prepare a cast ingot in a melt holding furnace, directly subjecting the cast ingot to twin-roller continuous casting to prepare a thin sheet having a thickness of 2 to 10 mm, cold rolling the sheet, correction of the resulting sheet to prepare an aluminum support, and then graining the aluminum support.

4. A method of producing a support for planographic printing plate as claimed in claim 2, which consists essentially of melting an aluminum ingot having an aluminum content of not less than 99.7 wt % to prepare a cast ingot in a melt holding furnace, directly subjecting the cast ingot to twin-belt continuous casting to prepare a thin sheet having a thickness of 10 to 30 mm, hot rolling the sheet having a thickness of 2 to 10 mm, cold rolling the sheet, correction of the resulting sheet to prepare an aluminum support, and then graining the aluminum support.

* * * * *